US006241941B1

(12) United States Patent
Stilkerieg

(10) Patent No.: US 6,241,941 B1
(45) **Date of Patent: *Jun. 5, 2001**

(54) DEVICE FOR AVOIDING CONTAMINATION OF THE TAPPED STEEL BY FLUSH SLAG IN A TILTABLE CONVERTER WITH IMPROVED COMPOSITION OF THE MATERIAL

(76) Inventor: Berthold Stilkerieg, Dahlienweg 22, Niederzissen (DE), 56651

( * ) Notice: Subject to any disclaimer, the term of this patent is extended or adjusted under 35 U.S.C. 154(b) by 0 days.

This patent is subject to a terminal disclaimer.

(21) Appl. No.: 09/404,138

(22) Filed: Sep. 27, 1999

(30) Foreign Application Priority Data

Oct. 17, 1998 (DE) ..... 198 48 004

(51) Int. Cl.[7] ..... C21C 5/48
(52) U.S. Cl. ..... 266/272; 501/129
(58) Field of Search ..... 266/271, 272, 266/45; 501/129

(56) References Cited

U.S. PATENT DOCUMENTS 4,471,950 * 9/1984 LaBate ..... 266/272
4,826,139 * 5/1989 Van Es ..... 266/272
4,828,226 * 5/1989 Komanecky ..... 266/45
4,877,221 * 10/1989 Scriven ..... 266/272
4,913,404 * 4/1990 Warman ..... 266/45
4,995,594 * 2/1991 Verbik ..... 266/272
5,151,243 * 9/1992 Auer et al. ..... 266/272
5,972,281 * 10/1999 Stilkerieg et al. ..... 266/45

* cited by examiner

*Primary Examiner*—Scott Kastler
(74) *Attorney, Agent, or Firm*—James Creighton Wray; Meera P. Narasimhan

(57) ABSTRACT

A device serves to seal the tap hole 10 of a tiltable converter with a sealing plug 8. The sealing plug 8 is characterised in particular by the composition of its material. Plastics material, preferably polystyrene foam in the shape of balls, serves therein, among other things, as material for the sealing plug 8. This gives the sealing plug 8 a considerably lower weight and above all guarantees more favourable deformation properties. The addition of the plastics material causes the sealing plug to melt or evaporate more quickly on impact by liquid steel, thus resulting in simpler and more precise handling of a converter.

13 Claims, 2 Drawing Sheets

DEVICE FOR AVOIDING CONTAMINATION OF THE TAPPED STEEL BY FLUSH SLAG IN A TILTABLE CONVERTER WITH IMPROVED COMPOSITION OF THE MATERIAL

BACKGROUND OF THE INVENTION

The invention relates to a device for sealing the tap hole of a tiltable converter with a sealing plug consisting of a front metal plate which points towards the inside of the converter and melts on impact by liquid steel and a setting tool via which the sealing plug can be inserted into the tap hole and is deformable therein against the wall thereof, the sealing plug having a cylindrical plastic core covered by the front metal plate and a base plate, which are connected displaceably with respect to one another to the setting tool.

Tiltable converters have, in a suitable place in the converter wall above the tank level, a discharge orifice or a tap hole for conveying the liquid steel into the tapping ladle. For emptying, the converter is tipped into such a position that the steel flows through the tap hole into the attached ladle. As specifically lighter slag of varying viscosity always floats on the molten metal, during the tipping process this slag inevitably reaches the tap hole first and thus fairly large amounts of flush slag reach the tapping ladle. For numerous subsequent metallurgical processes the presence of oxygen-rich slag frequently enriched with phosphorus or sulphur is a considerable disadvantage. There is therefore a demand for conveying the converter steel into the tapping ladle with as little slag as possible. A sealing plug for this purpose is known from EP 0 635 071, in which the front metal plate is designed to pass into a funnel-shaped channel which intersects the sealing plug and core and is designed to receive a drawing claw acting on the front metal plate. The sealing plug is pushed so far into the converter wall that with its front metal plate it is positioned approximately in alignment with the inside of the converter and is then set by pulling the claw. The front metal plate passes into a funnel-shaped channel, which intersects the sealing plug, so the fixing of the plug actually does take place on the inside of the converter and not on its outer wall. Once the sealing plug is correspondingly set, the front metal plate fuses and neither slag nor other parts can flow out through the tap hole. In fact the converter can be tipped, the front metal plate and also the funnel-shaped channel now melting on contact with the liquid steel and the steel being able to flow specifically into the ladle through the funnel-shaped channel. A sealing plug of this kind consists of refractory material, primarily aluminosilicate, bonding clay, water and mineral oil.

This gives rise to problems with regard to ease of handling. This is due on the one hand to the great weight of the sealing plug, and on the other hand to a high water consumption caused by using clay a s bonding agent, as well as, in particular, to the extremely rigid design and the associated difficult deformation of the sealing plug when it is placed into the converter hole.

SUMMARY OF THE INVENTION

The object of the invention is therefore to create a sealing plug which, owing to the composition of its material, guarantees better deformation properties, easier removability from the converter hole and therefore in general greater ease of handling, with the result, in particular, that sealing plugs of this kind can also be used in larger converters than formerly.

This object is achieved according to the invention in that the mixture of the c ore serving as refractory material has easily meltable hydrocarbon compounds. This plastics material guarantees considerably better properties compared with the formerly used bonding clay. This is demonstrated particularly by the fact that with the sealing plug according to the invention the opening behaviour when the converter is being tipped is greatly improved because the plastics material as a component of the sealing plug melts or evaporates. On the other hand the sealing plug equally guarantees that, owing to the high radiation heat on the inside of the converter, the metal plate melts and fuses with the refractory material into a firm cap, but there is no simultaneous fusing with the wall of the tap hole. The fused cap remains stable until, when the converter is tipped, it conducts the flush slag safely via the tap hole. The cap only breaks down under the ferrostatic pressure. The remaining plug material is carried out within a few seconds by the outflowing steel. This process is distinctly easier to handle with the design according to the invention, owing to the properties of the material of the plastics material.

A preferred embodiment of the invention proposes that the core has a proportion by weight of easily meltable hydrocarbon compounds of 10 to 40%.

It has proved to be particularly advantageous therein if the core has a weight proportion of easily meltable hydrocarbon compounds of 33%. With this proportion, particularly favourable opening of the sealing plug was observed.

It has proved to be advantageous if the permanent binders are silicates, the temporary binders cellulose material, the plasticisers polyelectrolytic alcohols and the liquifiers fatty acids. A material is thus created which ensures that the plug is effectively fixed in the tap hole during deformation without continuous fusing occurring. The remaining mass is also protected from disintegration by corresponding heat action. Advantageously it is further proposed that the plastics material is foam-like in design. The favourable fusing properties of the plastics material are exploited even better in this way. The foam is manufactured in such a way that it represents a surface which is closed as far as possible, a space advantage thereby being achieved.

It is particularly advantageous if the plastics material consisting of hydrocarbon compounds is a polystyrene foam. This material has the advantage that its use causes no excessively high costs and it is optimally suited for processing with the other materials, so the sealing plug according to the invention guarantees reliable operation. Polystyrene with a low weight ensures that the sealing plug is pressed out of the tap hole at the most favourable moment. In particular the way these hydrocarbon compounds melt or evaporate advantageously causes parts of the sealing plug to dissolve and even less remaining plug material is carried out by the outflowing steel.

To simplify handling the invention proposes that the plastics material has the shape of balls. These balls guarantee the desired deformability of the sealing plug on its installation in the tap hole. The sealing plug is inserted into the tap hole with the aid of the setting tool. Via the lever system of the setting tool the drawing claw is pulled on to the front metal plate, whereby a pressure is exerted on the material which now deforms until the diameter of the tap hole has been completely filled. Small balls prove to be best for this process, as they adapt optimally to the movements and deformations.

It is particularly advantageous if the plastics material balls have a size of 1 to 2 mm. By choosing these extremely small plastics material balls uniform and spacious distribution is ensured. It is even possible to achieve spaces with these extremely small plastics material balls. Altogether a texture results which, owing to its fine structure, is quasi solid, while at the same time it is guaranteed that the sealing plug according to the invention fulfils its required function and is pressed out of the tap hole with as good control as possible.

For better bonding of the plastics material balls into the total mass it is proposed that the plastics material balls are provided with wetting agents. The plastics material balls provided with wetting agents are consequently coated with the clay, resulting in a more favourable structure of the material.

In addition it is proposed that the plastics material is fibrous in design. By this measure the wetting action is intensified and a more favourable and more uniform distribution of the material of the plug guaranteed.

Owing to the design of the sealing plug according to the invention the possibility now arises of arranging the abutment for holding the drawing claw in the region between front and centre of the sealing plug. Consequently the drawing claw no longer inevitably has to be pressed at the front end of the sealing plug, but can also be arranged at other places, depending on requirement and according to external circumstances. This is due to the fact that there is no need for the funnel-shaped design of the sealing plug at its front end because, owing to the deformation of the drawing claw, the deformation path becomes shorter and more direct.

It can be seen from the foregoing that the cylindrical core of the sealing plug is formed from refractory material as a mixture of 10 to 40% weight hydrocarbon compounds 20 to 40% weight bonding clay 20 to 40% weight aluminosilicate 0 to 20% weight water 5 to 20% weight oil 0.5 to 3% weight plasticiser 0.1 to 2% weight liquifier 0.1 to 2% weight temporary binders.

0.1 to 5% weight permanent binders.

The invention is characterised in particular in that a sealing plug is created which, owing to the composition of its material, has flexible deformation properties. Thus precise functioning of the sealing plug is achieved because the moment of release from the tap hole can be predetermined more exactly. The properties of the plastics material also contribute appreciably thereto with regard to their meltability.

Thus the manufacture of the individual components is greatly facilitated.

Further details and advantages of the object of the invention emerge from the following description of the associated drawings, in which a preferred embodiment is illustrated with the necessary details and individual parts.

DETAILED DESCRIPTION

Figure 1:
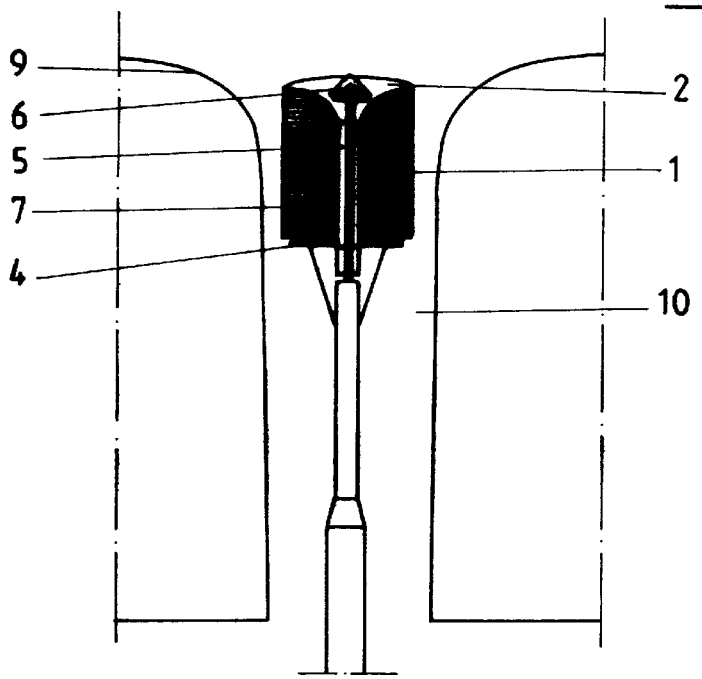
FIG. 1 is a section through a converter in the region of the tap hole with pushed-in sealing plug.

The sealing plug generally designated in the figures as 8 has a cylindrical shape and consists of fire-resistant material. To this is allocated a metal plate 2, which has an elongated channel 5 guided through the sealing plug 8. The drawing claw 6 is guided through the channel 5 to above the front end 12 of the sealing plug 8. The object of the drawing claw 6 is to hold the sealing plug 8 in the tap hole 10 until its final positioning. The sealing plug 8 is inserted into the tap hole with the aid of the setting tool until with its squeezing metal plate face, i.e. therefore the surface of the front metal plate 2, it is approximately aligned with the inside of the converter 9. Via the lever system of the setting tool, the drawing claw 6 is pulled on to the metal plate 2. A pressure is thereby exerted on the plug material, which now deforms until the diameter of the tap hole 10 is completely filled. This process is substantially facilitated by the fact that the sealing plug according to the invention 8 can be deformed and thus allows a more exact adaptation between metal plate 2 and sealing plug 8.

Figure 2:
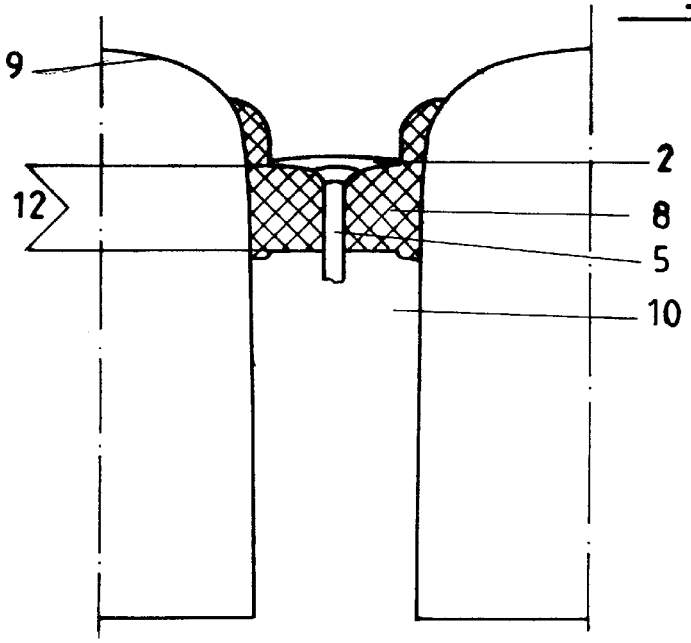
FIG. 2 is a section through a converter in the region of the tap hole with inserted and squeezed sealing plug.

FIG. 2 shows the sealing plug 8 in the inserted, deformed state. The deformability of the sealing plug 8 is achieved owing to the composition of the material. The small plastics material balls in particular also guarantee, as well as the considerably lower weight, the flexible adaptation of sealing plug 8 to the front metal plate 2. A further advantage of using the plastics material containing hydrocarbon compounds is in the easier and thus more easily controllable meltability or evaporating when the sealing plug according to the invention 8 is pressed out of the tap hole.

The thickness of the floor of the plug or remains of the plug is always adhered to for each tapping diameter of a converter with the aid of the setting tool, so repeatable opening behaviour is ensured. Owing to the high radiation heat on the inside of the converter 9 the metal plate 2 melts and fuses with the refractory material into a firm cap. This withstands the blowing pressure and the occurring vibrations and shocks. The remaining refractory insulating material compacts far enough to remain stably contained in the tap hole 8. No fusion takes place with the wall of the tap hole 8. The fused cap is so stable that when the converter is tipped it conveys the flush slag safely via the tap hole 8 and only breaks up under the ferrostatic pressure.

Figure 3:
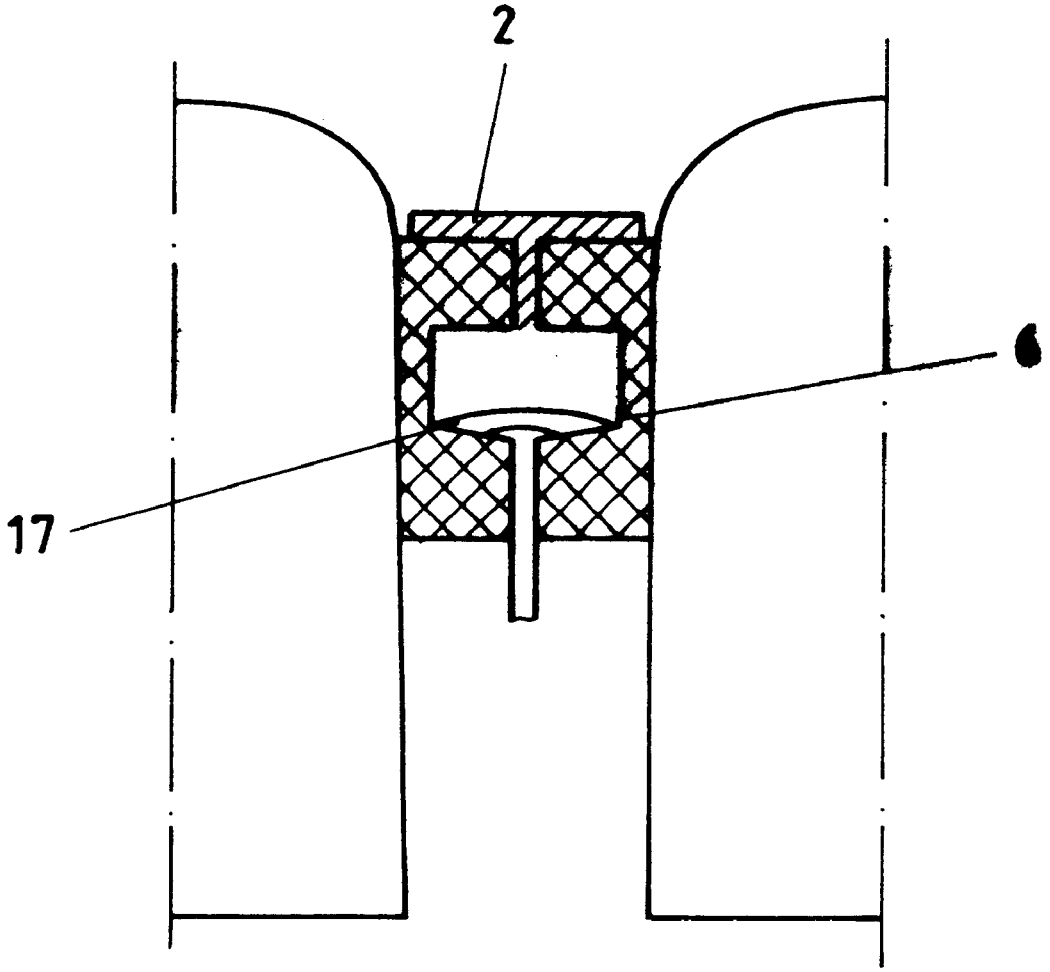
FIG. 3 shows a sealing plug in which drawing claw and front metal plate engage at two different points.

FIG. 3 shows an alternative embodiment, in which the metal plate 2 is not arranged at the front end 12 of the sealing plug 8, but at about its centre 16 and metal plate 2 and drawing claw 6 are deformed at different points, namely front end 12 and centre 16. The centre 16 of the sealing plug 8 is not necessarily the fitting point for the drawing claw 6, and other points are conceivable here, if it is intended to separate the locations of drawing claw 6 and metal plate 2, for example for the uniform loading of the sealing plug 8 and to avoid spikes.

All features mentioned, even those which can only be inferred from the drawings, are considered on their own and in combination as essential to the invention.

What is claimed is:

1. Device for sealing a tap hole (10) of a tiltable converter with a sealing plug (8) consisting of a front metal plate which points towards an inside of the converter (9) and melts on impact by liquid steel and a setting tool via which the sealing plug (8) is insertable into the tap hole (10) and is deformable therein against the wall thereof, the sealing plug (8) having a cylindrical plastic core (1) covered by the front metal plate (2) and a base plate (4), which are connected displaceably with respect to one another to the setting tool, characterised in that a mixture of a core (1) serving as refractory material has easily meltable hydrocarbon compounds.

2. Device according to claim 1, characterised in that the core (1) has a proportion by weight of easily meltable hydrocarbon compounds of 10 to 40%.

3. Device according to claim 1, characterised in that the core (1) has a proportion by weight of easily meltable hydrocarbon compounds of 33%.

4. Device according to claim 1, characterised in that the hydrocarbon compounds further comprise one of the group consisting of permanent binders, temporary binders, plasticizers and liquefiers.

5. Device according to claim 4, characterised in that the permanent binders are silicates, the temporary binders cellulose material, the plasticisers polyelectrolytic alcohols and the liquifiers fatty acids.

6. Device according to claim 1, characterized in that the core is of plastics material consisting of hydrocarbon compounds, wherein the plastics material is foam material.

7. Device according to claim 6, characterised in that the plastics material is a polystyrene foam.

8. Device according to claim 1, characterised in that the core is of plastics material having the shape of balls.

9. Device according to claim 8, characterized in that the balls have a size of 1 to 2 mm.

10. Device according to claim 8, characterized in that the balls are provided with wetting agents.

11. Device according to claim 1, characterised in that the core is of plastics material of fibrous design.

12. Device according to claim 1, characterized in that an abutment for accommodating a drawing claw is arranged in a region between front and center of the sealing plug.

13. Device according to claims 1, characterised in that the core (1) of the sealing plug (8) is cylindrical and is formed from refractory material as a mixture of 10 to 40% weight hydrocarbon compounds 20 to 40% weight bonding clay 20 to 40% weight aluminosilicate 0 to 20% weight water 5 to 20% weight oil 0.5 to 3% weight plasticiser 0.1 to 2% weight liquifier 0.1 to 2% weight temporary binders 0.1 to 5% weight permanent binders.

* * * * *